US006647664B1

(12) United States Patent
Kochan, Sr.

(10) Patent No.: US 6,647,664 B1
(45) Date of Patent: Nov. 18, 2003

(54) HANGER FOR A HOUSING

(75) Inventor: John R. Kochan, Sr., Naperville, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 222 days.

(21) Appl. No.: 09/603,943

(22) Filed: Jun. 27, 2000

(51) Int. Cl.[7] ..... E05D 15/28
(52) U.S. Cl. ..... 49/248; 49/246; 312/249.7
(58) Field of Search ..... 49/248, 246, 247, 49/249, 250; 312/223.1, 249.7, 321.5

(56) References Cited

U.S. PATENT DOCUMENTS 1,068,045 A * 7/1913 Douthett ..... 49/248
1,129,389 A * 2/1915 Heller ..... 312/120
1,185,013 A * 5/1916 Shaver ..... 49/248
1,360,376 A * 11/1920 Douthit ..... 312/227
2,070,511 A * 2/1937 Clements ..... 312/310
2,099,778 A * 11/1937 Todd ..... 49/248

* cited by examiner

*Primary Examiner*—Lanna Mai
*Assistant Examiner*—Jerry A. Anderson
(74) *Attorney, Agent, or Firm*—Welsh & Katz, Ltd.

(57) ABSTRACT

A control panel, which might be enclosed within an openable housing, can be movably supported on a pivotable support structure. The support structure which incorporates one or more pivot points facilitates movement of the control panel from a normal operational position to a displaced maintenance/service position the control panel can be moved both arcuately and linearly on the support element.

4 Claims, 3 Drawing Sheets

HANGER FOR A HOUSING

FIELD OF THE INVENTION

The invention pertains to devices which facilitate movement of housings, which might include electrical equipment, for installation or service purposes. More particularly, the invention pertains to such devices which incorporate multiple pivots whereby the housing can be moved in two directions while at the same time a particular orientation can be maintained.

BACKGROUND OF THE INVENTION

Various ways have been developed to provide access to mechanical and electrical equipment for installation or service. For example, removable panels have long been used to provide access. However, merely removing a panel or opening a door does not displace any of the equipment behind or adjacent to the panel or door to facilitate installation or service functions.

Alternately, electrical and electronic chassis have been mounted on pull-out slides which not only displace the chassis but can also provide a rotary degree of freedom. With such slides, the respective chassis can be both translated and rotated to present a bottom or a back panel for service or maintenance.

Hinges have also been used to make it possible to rotate housings, or other equipment for service. While hinges to permit the respective housings or equipment to be moved, such motion is limited to rotation through a particular angle.

Known solutions have not made it possible to conveniently and cost effectively move equipment temporarily out of the way so that other equipment in the immediate area can be serviced. This is especially a problem in installations where space is at a premium and the various devices, control systems, pumps motors and the like are assembled adjacent to an exterior housing or protective enclosure. Installation and service is always a challenge where it is necessary to work immediately next to a side wall or roof of a housing or enclosure. Where the installed equipment is bulky or heavy the problem is exacerbated.

There thus continues to be a need for devices which will conveniently and easily facilitate the movement of equipment. Preferably such devices will be able to support a wide range of weights or configurations while at the same time continuing to perform in harsher environments than in office buildings Preferably such divides will themselves be low maintenance, robust devices which can be incorporated into larger pieces of equipment without adding substantially to the cost of the associated housing or equipment being supported.

SUMMARY OF THE INVENTION

An equipment carrying device incorporates first and second spaced apart pivots. A two part support arm extends between the pivots. One part of the arm is at a selected angle relative to the other. Acceptable angles fall into a range of 35 to 135 degrees.

In one aspect, a single arm can be used. One pivot is rotatably coupled to a fixed pivot support. The other pivot is rotatably coupled to a device or housing to be supported.

As the supported device or housing is pulled or pushed, it can move in one or two directions. One direction is away from or toward the fixed pivot support. A second direction is generally perpendicular to the one direction. The relationship between the directions is set by the angle between the arms.

In one embodiment, the arms can be oriented at ninety degrees to one another. As the arms rotate about the fixed pivot support, a piece of equipment carried at the second pivot can be maintained at a fixed relationship to that support. Where the equipment is supported at a first position adjacent to a housing, it can be moved to a displaced second location. In this location, the equipment can retain the same orientation as when in the first position.

The device thus makes it possible to move equipment from an initial, operating position to a final, service position with little effort. Since the equipment is displaced in two directions, when in the final position it has been moved enough that the initial position has been vacated. An opening remains at the initial position through which maintenance personnel can access other equipment located behind the equipment which has been moved out of the way. The structure of the device provides flexibility in the orientation of the equipment when in the final position.

In another embodiment, heavier equipment can be supported for movement by using two arms. The pivot axes share a common center line.

In yet another embodiment, a hanger includes an angle bracket having first and second rigid members joined at an angle to one another. One end of the bracket is pivotably supported on a mounting post.

The housing is movable in two directions, in a horizontal plane, for access or service. The rigid members can be pivotably attached to one another. The housing can be rigidly coupled to one of the rigid members. Alternately, the housing can be pivotably coupled, at a central location to the rigid member.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1A:
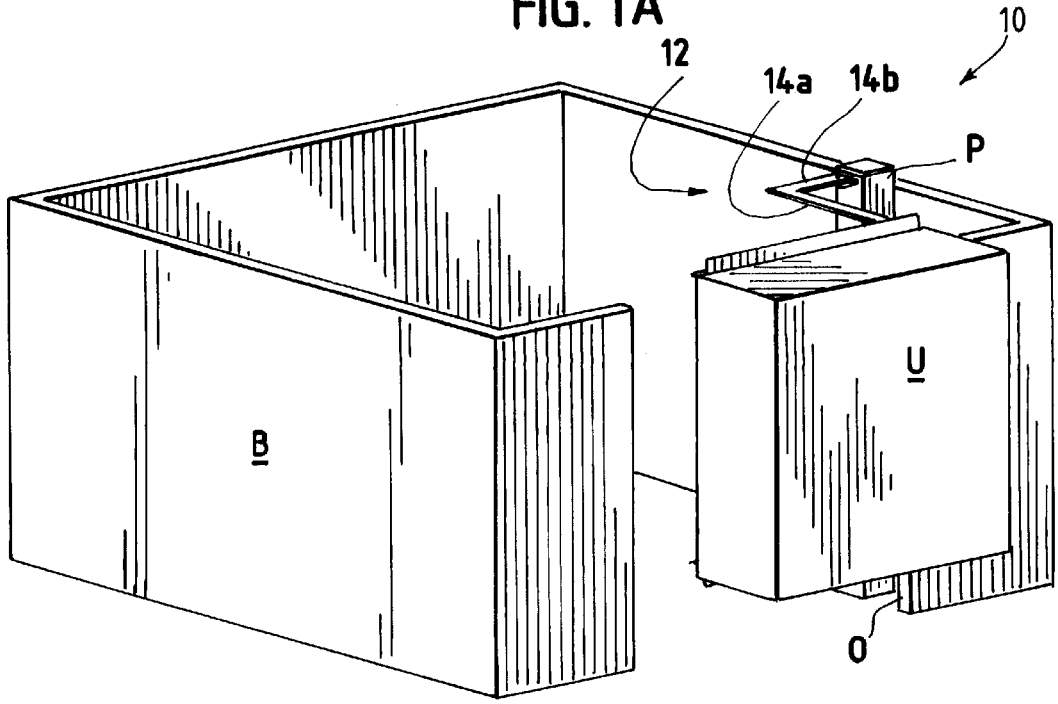
FIGS. 1A–1C taken together are perspective views of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 1B:
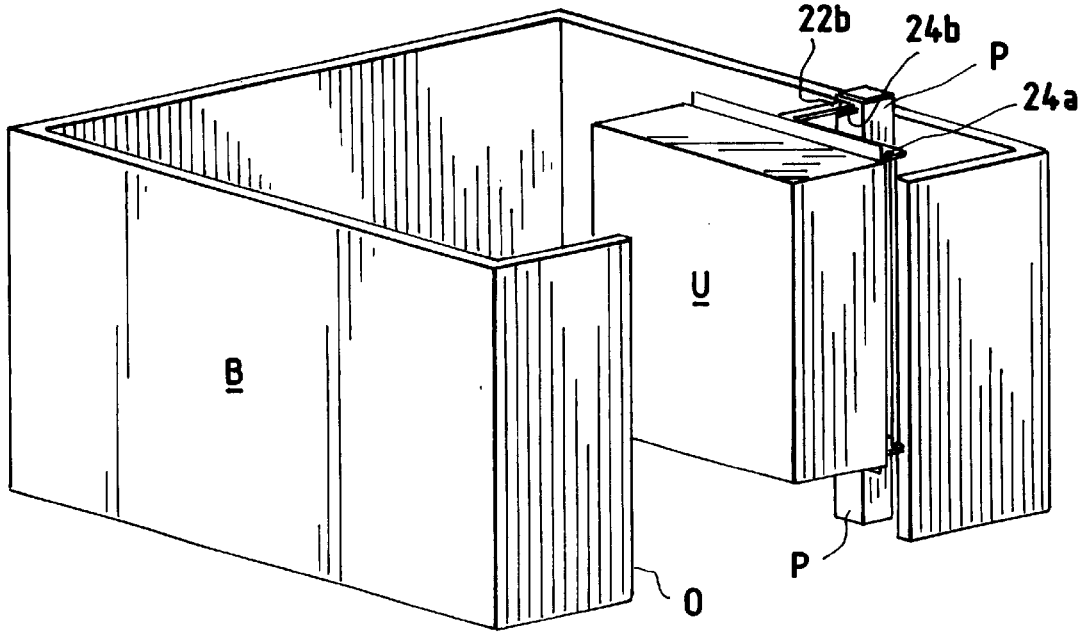
Figure 1C:
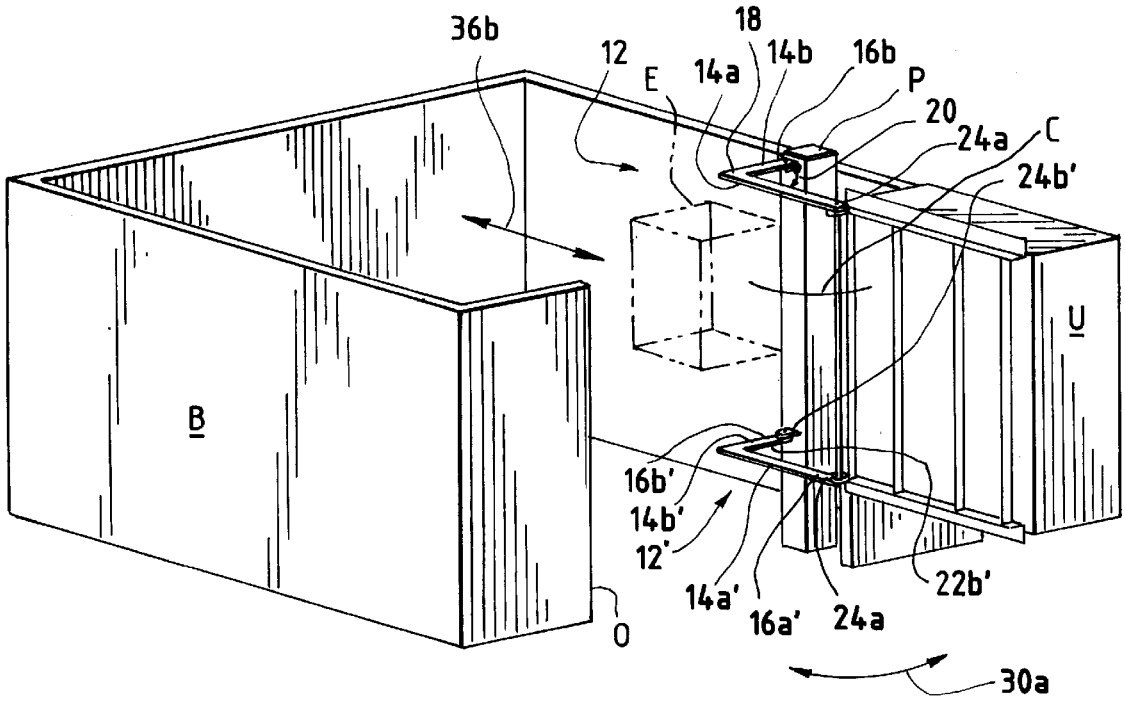

FIGS. 1A–1C illustrate various views of an embodiment of a system 10 in accordance with the present invention. The system 10 can movably support the unit U from a fixed post P.

Where the post P is located adjacent to or within an opening O of a building B, the unit U can be moved linearly and/or arcuately into and away from the Opening O. When moved into the opening O, the Unit U assumes its normal operating location. The Unit U can be electrically connected via cabling and/or conductors C to other equipment located within the Building B.

The other equipment can include without limitation motors, sensors or transducers or the like, all without limitation. Also without limitation, the unit U can be a closed housing which carries control elements of various types therein.

For maintenance and service purposes, the system 10 enables the personnel to move the unit U away from the opening O to gain access to the building B. When service or maintenance work is concluded, the unit U is re-positioned, on the support system 10, to again close off, at least in part, the opening O.

The system 10 includes at least one support element 12 which includes first and second rigid elongated sides 14*a*, 14*b*. Each of the sides has a free end, corresponding to free end 16*a* and free end 16*b*.

In the embodiment of FIG. 1*c*, the sides 14*a, b* of the element 12 are fixedly attached to one another at a region 18. For stability and convenience, the system 10 can incorporate a second support element 12' which is displaced from but substantially identical to the element 12.

The first and second sides 14*a*, 14*b* are oriented at an angle 20 relative to one another. The angle 20, in a preferred embodiment of the system 10 is on the order of 90°. However, the angle 20 can extend in a range from 30 to 150° without departing from the spirit and scope of the present invention.

Each of the free ends 16*b*, 16*b*' of the sides of 14*b*, 14*b*' carries a pivotable coupling, for example, a pin, a socket or any other pivotable coupling 22*b*, 22*b*'. The adjacent post P carries a mating pivotable coupling element 24*b*, 24*b*'.

The unit U is pivotably attached to free ends 16*a*, 16*a*' of sides 14*a*, 14*a*'. Each of the free ends 16*a*, 16*a*' carries a pivotable coupling which rotatable engages a respective coupling element 24*a*, 24*a*'. The coupling elements 24*a*, 24*a*', which can be attached to the unit U by a bracket such as would be known to those of skill in the art, in conjunction with the coupling elements 24*b*, 24*b*' make it possible to translate and rotate the unit U out of the opening O and off to the side for service access within the building B. Motion can be both arcuate 30*a* and linear 30*b*.

Figure 2B:
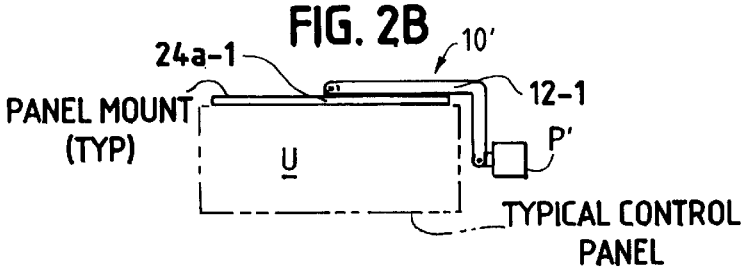
FIG. 2B is a top plan view of the system of FIG. 2A.
Figure 2A:
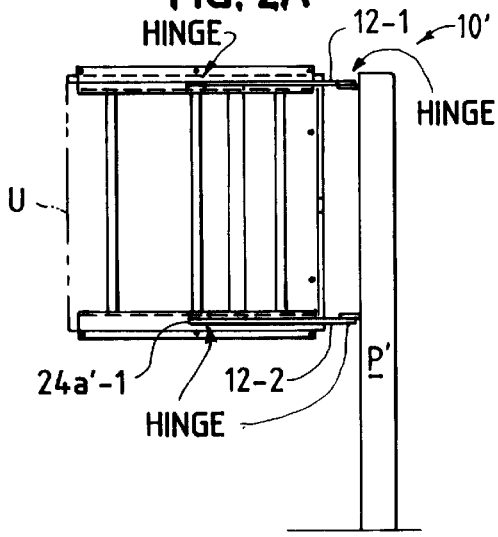
FIG. 2A is a side elevational view of an alternate system in accordance with the present invention.

As will be understood by those skill in the art, the elements of the system 10 can be varied without departing from the scope of the present invention. For example, FIGS. 2*a* and 2*b* illustrate alternate embodiment 10' in accordance with the present invention. The system 10 includes first and second support elements 12-1, -2 comparable to the elements 12, 12' of the system 10. In the system 10', the unit U is supported by centrally located pivoting joints 24*a*-1, 24*a*'-1. Hence, the unit U can be rotated on the two pivots illustrated in the system 10' for both arcuate and linear displacement.

Figure 2C:
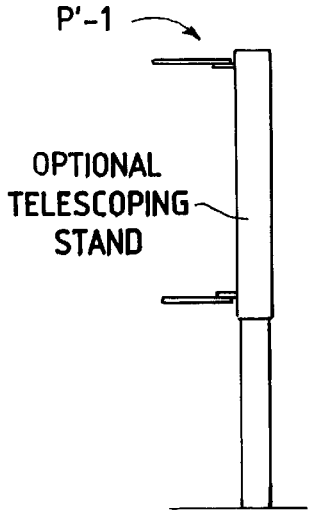
FIG. 2C is a side elevational view of an alternate form of a support post in accordance with the present invention.
Figure 3:
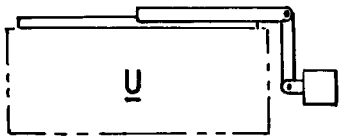
FIG. 3 is a top plan view of another system in accordance with present invention.
Figure 6:
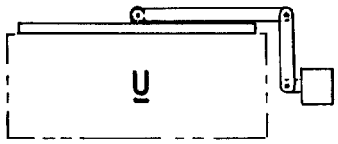
FIG. 6 is a top plan view of yet another system in accordance with the present invention.
Figure 4:
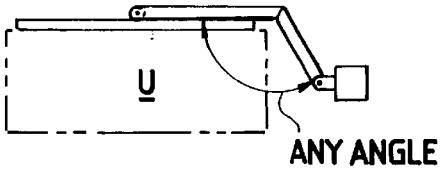
FIG. 4 is a top plan view of yet another system in accordance with the present invention.

FIG. 2C illustrates a post P'-1 which has a two-part telescoping structure for purposes of moving the unit U vertically in addition to the previously discussed motion in a horizontal plane.

FIGS. 3 through 6 illustrate multi-pivot support structures in accordance with the present invention with various illustrated alternative configurations. As those of skill in the art will understand, the support structures of FIGS. 3 through 6 as was the case with systems 10, 10' support the respective unit U for movement in both linear and arcuate directions simultaneously.

Figure 7:
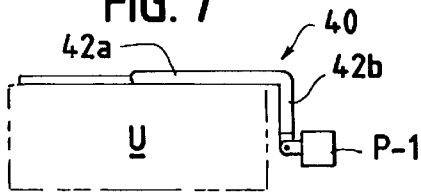
FIG. 7 is a top plan view of an embodiment of a different system in accordance with the present invention.
Figure 5:
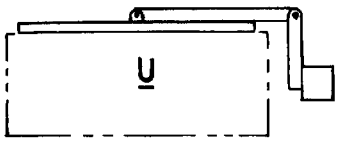
FIG. 5 is a top plan view of yet another system in accordance with the present invention.
Figure 8:
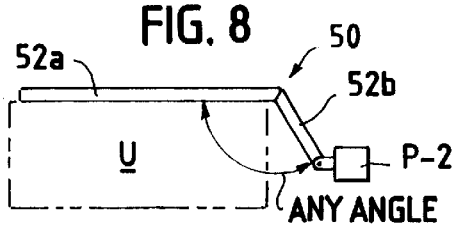
FIG. 8 is a top plan view of yet another embodiment of a system in accordance with the present invention.

FIGS. 7 and 8 illustrate single-pivot systems 40 and 50 in accordance with the present invention. In each of systems 40, 50, at least support element having first and second sides oriented at an angle therebetween, for example 42*a*, 42*b* or 52*a*, 52*b* are movably supported by a pivotable joint carried on a respective post P-1, P-2. In the embodiments of FIGS. 7 and 8, the unit U is fixedly attached, without relative motion, to the respective side of 42*a*, 52*a*. Notwithstanding the presence of only a single pivoting axis, adjacent to the respective supporting post P-1, P-2, the systems 40, 50 will move the support of unit U both arcuately and linearly relative to the support post P-1, P-2.

In all instances, the embodiments disclosed herein make it possible to translate and rotate a support of the unit such as the unit U into and out of an opening of an enclosure or building for purposes of service and maintenance. The support of the unit U remains electrically connected to equipment within the structure to facilitate maintenance and service while the unit U has been moved from its normal operating position to its service position.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An assembly comprising:

an enclosure that at least in part bounds an interior region and defines an opening into the interior region;

a support element located within the interior region, the support element defines a first plane parallel to the opening;

a support bracket having first and second connected arms, the arms are disposed at an angle that falls in a range of thirty degrees to one hundred fifty degrees with a first bracket end of the first arm pivotably attached in the region to the support element and with a second bracket end of the second arm displaced therefrom;

a housing pivotably attached to the second bracket end of the second arm, the housing defines a second plane parallel to the first plane, the housing is movable relative to the support element through the opening into the interior region generally toward the element, and out of the interior region generally away from the element, with the two planes staying parallel to one another as the housing moves, the housing is rotatable to a position in the interior region so that the two planes are substantially perpendicular to one another with the housing rotatable on the order of one hundred eighty degrees from the position in the interior region to a second position substantially outside of the enclosure.

2. An assembly as in claim 1, the housing has first and second spaced apart sides with the pivotable attachment to the second bracket end of the second arm located adjacent to one side.

3. An assembly as in claim 1 with the housing having a first, outer, surface, the housing having a first position that at least in part blocks the opening into the interior region with the first surface extending from the region and accessible from outside of the enclosure when the housing is in the first position, the housing is movable to a second, different, position with the first surface located within the interior region.

4. An assembly comprising:

an enclosure that at least in part bounds an interior region and defines an opening into the interior region;

a support located within the interior region, the support defines a first plane parallel to the opening;

a support bracket having first and second connected arms, the arms are disposed relative to one another at an angle that falls in a range of thirty degrees to one hundred fifty degrees with a first bracket end of one arm pivotably attached in the region to the support;

a housing pivotably attached to a second bracket end of the second arm, the housing defines a second plane parallel to the first plane, the housing is movable relative to the support entirely through the opening into the interior region generally toward the support, and out of the interior region generally away from the support, with the two planes staying parallel to one another during at least part of the movement of the housing, the housing is movable to a position in the interior region so that the two planes are substantially perpendicular to one another, the housing having a first, outer, surface, the housing having a first position that at least in part blocks the opening into the interior region with the first surface extending from the region and accessible from outside of the enclosure when the housing is in the first position, the housing is movable to a second, different, position with the first surface located within the interior region and the housing is rotatable from the second position in the interior region to a third position outside of the enclosure.

* * * * *